United States Patent [19]

Yamaguchi et al.

[11] Patent Number: 4,870,850

[45] Date of Patent: Oct. 3, 1989

[54] METHOD AND DEVICE FOR LEVELING METAL STRIP TO BE FED INTO CONTINUOUS ANNEALING FURNACE

[75] Inventors: Yasuhiro Yamaguchi; Yuji Shimoyama; Tateo Ohnishi; Hironobu Ohno; Isamu Shioda; Yoji Nakazono, all of Chiba, Japan

[73] Assignee: Kawasaki Steel, Japan

[21] Appl. No.: 94,662

[22] Filed: Sep. 4, 1987

[30] Foreign Application Priority Data

Sep. 9, 1986 [JP] Japan ..... 61-211909
Sep. 30, 1986 [JP] Japan ..... 61-230125

[51] Int. Cl.[4] ..... B21D 1/02

[52] U.S. Cl. ..... 72/164; 72/205; 72/202

[58] Field of Search ..... 72/164, 165, 160, 12, 72/16, 17, 205, 202

[56] References Cited

U.S. PATENT DOCUMENTS

| | | | |
|---|---|---|---|
| 2,001,637 | 5/1935 | Talbot | 72/165 |
| 3,104,567 | 9/1963 | Sieger | 72/11 |
| 3,171,464 | 3/1965 | Holtz . | |
| 3,395,559 | 8/1968 | Ungerer | 72/164 |
| 3,416,340 | 12/1968 | Reesor | 72/164 |
| 3,584,853 | 6/1971 | Manson . | |
| 3,777,532 | 12/1973 | Noe | 72/160 |

FOREIGN PATENT DOCUMENTS

| | | | |
|---|---|---|---|
| 2246161 | 3/1973 | Fed. Rep. of Germany | 72/9 |
| 1014215 | 8/1952 | France | 72/17 |
| 141529 | 11/1980 | Japan . | |
| 76223 | 4/1985 | Japan . | |
| 1109039 | 4/1968 | United Kingdom . | |

*Primary Examiner*—Daniel C. Crane
*Attorney, Agent, or Firm*—Austin R. Miller

[57] ABSTRACT

A method for leveling a metal strip performs a leveling operation by opening leveling rolls at a predetermined position relative to a welded joint and closing at a predetermined position relative to the welded joint. The tension exerted on the metal strip while the leveling rolls are held open is set at a given value in relation to the metal strip length where the leveling rolls are held open. The tension to be exerted on the metal strip while leveling is selected so that the tension may cause a given rate of elongation on the metal strip and thereby levels the metal strip. The leveling device is applicable for implementing the leveling process including a quick open and a quick close upon encountering welded joints of the strips. The leveling device includes features in that the leveling rolls as held open and thus released from the metal strip and self-propelled to rotate.

17 Claims, 3 Drawing Sheets

METHOD AND DEVICE FOR LEVELING METAL STRIP TO BE FED INTO CONTINUOUS ANNEALING FURNACE

BACKGROUND OF THE INVENTION

1. Field of the Invention

The present invention relates generally to a method device for leveling a series of metal strip to subject heat treatment, such as annealing. More specifically, the invention relates to a technique for effectively performing metal strip leveling operation with avoidance of breakage at welded joint, or defects in the series of metal strip.

2. Description of the Background Art

In general, a plurality of hearth rolls are arranged in a continuous annealing furnace for defining a zig-zag path through known heat treatment stages, such as a heating stage, a soaking stage maintaining the metal strip at constant heated temperature, a cooling stage and so forth. The metal strip is wound around the hearth rolls and runs through the zig-zag path in the annealing furnace to be subjected to heat treatment.

In the practical operation of the annealing furnace, the metal strip at the zone cross to the inlet has a relatively low temperature. At this zone in the annealing furnace, the temperature at the transverse edge positions of the hearth roll tends to become much higher than that at the transverse central portion. This temperature difference between the edge portions and the central portion increases with increase of line speed. This causes a substantial difference of heat expansion at the edge portion and the central portion to cause reduction of the effective crown magnitude. This reduction of the crown tends to lead to unbalance of tension to be exerted on the metal strip in the transverse direction in the case that the metal strip is in the configuration of edge wave or center wave. Unbalanced tension tends to cause meander of the metal strip in the path.

In order to prevent this, the line speed to feed the metal strip through the annealing furnace has to be lowered in order to minimize the temperature difference between the edge portions and the central portions of the hearth roll. This clearly causes lowering of the efficiency of the annealing furnace. On the other hand, possibility of meander of the metal strip can be reduced by providing greater magnitude of the initial crown on the periphery of the hearth roll. This may allow maintaining a satisfactory line speed. On the other hand, when sufficient initial crown for the initial heating stage is provided for the hearth roll, the crown magnitude tends to be excessive at the high temperature zone to cause heat buckling when the line speed is lowered for some other reason, such as for welding the strips.

In this view, there are various proposals for obtaining stable operation of the annealing furnace by controlling magnitude of crown on the peripheries of hearth rolls. For example, such proposals have been disclosed in the Japanese Utility Model First (unexamined) Publication (Tokkai) Showa 57-177930 and the Japanese Utility Model First Publication (Jikkai) Showa 58-10546. In these prior proposals, crown magnitudes have been controlled by heating and cooling the hearth rolls. On the other hand, the Japanese Patent First Publication (Jikkai) Showa 55-172359 proposed to control the crown magnitude by means of a bending device.

On the other hand, the meander of the metal strip in the annealing furnace is also caused due to configuration of the metal strip, such as bending, transverse curve and so forth. If the configuration of the metal strip is not suitable for passing through the annealing furnace to cause uneven contact with the hearth roll surface, meandering of the metal strip is caused even when the crown magnitude is sufficient. This tendency increases with increase of line speed. In order to regulate or adjust the configuration of the metal strip, tension leveler devices are provided.

In general, such tension leveler devices exert substantial tension, e.g. 20 kg/mm$^2$. Such high tension exerted on the metal strip tends to cause breakage at the welded joint between leading and trailing metal coils, producing defects on the metal strip. On the other hand, because of the uneveness at the welded joint, leveling rolls in the tension leveler tend to be damaged due to high tension. In order to prevent breakage of the metal strip and/or damaging of the leveling rolls, steps have been taken to slow-down the line speed at the welded joint or to release the roll at the welded joint. Slow-down of the line speed necessarily causes lowering of the efficiency of the annealing furnace. On the other hand, releasing of the leveling rolls necessarily feeds the metal strip with unleveled portions to cause meandering in the annealing furnace.

SUMMARY OF THE INVENTION

Therefore, it is an object of the present invention to provide a method and device for leveling the metal strip which overcomes the aforementioned drawbacks in the prior art.

Another object of the present invention is to provide a method and device to perform a tension leveling operation for the metal strip which successfully eliminates meandering of the metal strip in the annealing furnace by controlling the tension exerted on the metal strip so that expansion of the metal strip due to the exerted tension can be set in relation to open and closed positions of the leveling rolls to release the rolls from the metal strip at the welded joint portion in order to establish an optimal relationship.

A further object of the invention is to provide a level device which is suitable for implementing quick open and quick close operation in the leveling operation for avoiding welded joints of the metal strip without requiring lowering of line speed.

In order to accomplish the aforementioned and other objects, a method for leveling a metal strip according to the present invention, performs leveling by opening leveling rolls at a predetermined position relative to the welded joint and closing them at a predetermined position relative to the welded joint. The tension to be exerted on the metal strip while the leveling rolls are held open is set at a given value in relation to the metal strip length where the leveling rolls are held open. The tension to be exerted on the metal strip is selected so that the tension may cause a given elongation on the metal strip and thereby levels the metal strip.

On the other hand, according to the invention, there is also provided a leveling device, which is applicable for implementing the leveling process including quick opening and quick closing at the welded joint of the strips. The leveling device according to the present invention provides features in that the leveling rolls are held open and thus released from the metal strip and is self-propelled to rotate.

According to one aspect of the invention, a method for leveling a metal strip to be fed into an annealing furnace, which metal strip is formed into a series of strips by connecting coils at a joint, comprises the steps of:

providing a leveling roll assembly which is constituted of first and second roll components disposed between opposite sides of a path through which the metal strip is fed;

providing means for exerting a predetermined magnitude of tension force to the metal strip during the leveling operation;

depressing the first and second components of the leveling roll assembly with a predetermined pressure for leveling the metal strip;

releasing the first component of the leveling roller assembly from the mating surface of the metal strip for releasing the metal strip from depressing pressure, at a joint of the series of metal strip; and rotatingly driving at least the released one of the first and second components while it is released from the metal strip.

In the method as set forth above, the rotation speed of the first component is variable depending upon the line speed of the metal strip. In practice, the rotation speed of the the first component is so adjusted as to have a given speed difference relative to the line speed so that the speed difference is reduced as the line speed is increased.

In practical operation, the rotation speed of the first component is adjusted so as to satisfy the following formula:

$$\Delta S \leqq LS$$

where

ΔS is the speed difference; and

LS is the line speed of the metal strip, when the line speed is lower than or equal to 150 m/min. and to satisfy the following formula:

$$\Delta S \leqq -a.LS + b$$

where

ΔS is the speed difference;

LS is the line speed of the metal strip;

a is 0.124; and b is 168.6 when the line speed is higher than 150 m/min.

On the other hand, the first component is released from the metal strip at a point a given distance ahead of the joint and contacted to the metal strip at a point a given distance after the joint.

According to another aspect of the invention, the metal strip is formed into a series of strips by connecting coils at a joint, and, comprises the steps of:

providing a leveling roll assembly which is constituted of first and second roll components disposed between opposite sides of a path through which the metal strip is fed;

providing means for exerting a predetermined magnitude of tension force to the metal strip during the leveling operation;

depressing the first and second components of the leveling roll assembly with a predetermined pressure for leveling the metal strip;

releasing the first component of the leveling roller assembly from the mating surface of the metal strip for releasing the metal strip from depressing pressure, at a joint in the series of metal strips; and adjusting the tension force to be exerted on the metal strip during the leveling operation to adjust the elongation of the metal strip in a predetermined relationship with the distance to satisfy the following equation:

$$\phi \geqq 0.0082(x/8\ L)^{1.45}$$

where $\phi$ is the elongation (%);

x is the distance; and

L is the span between the hearth rolls in the annealing furnace.

The leveling operation is to be performed for smoothing the surface of the metal strip to provide a steepness less than about 1%, where steepness means the ratio of a the height of the peak of projecting portion on the surface of the metal strip versus the distance from the peak to the bottom of adjacent depression.

According to a further aspect of the invention, a leveling device for leveling a metal strip to be fed into an annealing furnace, which metal strip is formed into a series of strips by connecting coils at a joint, comprises a leveling roll assembly which is constituted of first and second roll components disposed between opposite sides of a path through which the metal strip is fed, means for exerting a predetermined magnitude of tension force to the metal strip during the leveling operation, means for depressing the first and second components of the leveling roll assembly with a predetermined pressure for leveling the metal strip, means for releasing the first component of the leveling roller assembly from the mating surface of the metal strip for releasing the metal strip from depressing pressure, at a joint of the series of metal strips, and means for rotatingly driving the first component while it is released from the metal strip.

According to a still further aspect, a leveling device is provided for leveling a metal strip to be fed into an annealing furnace, which metal strip is formed into a series of strips by connecting coils at a joint, and comprises a leveling roll assembly which is constituted of first and second roll components disposed along opposite sides of a path through which the metal strip is fed, means for exerting a predetermined magnitude of tension force to the metal strip during leveling operation, means for depressing the first and second components of the leveling roll assembly with a predetermined pressure for leveling the metal strip, means for releasing the first component of the leveling roller assembly from the mating surface of the metal strip for releasing the metal strip from depressing pressure, at a joint of the series of metal strips, and means of adjusting the tension force to be exerted on the metal strip during the leveling operation to adjust the elongation of the metal strip in a predetermined relationship with the distance to satisfy the following equation:

$$\phi \geqq 0.0082(x/8\ L)^{1.45}$$

where $\phi$ is elongation (%);

x is the distance; and

L is a span between hearth rolls in the annealing furnace.

BRIEF DESCRIPTION OF THE DRAWINGS

The present invention will be understood more fully from the detailed description given herebelow and from the accompanying drawings of the preferred embodiment of the invention, which, however, should not be taken to limit the invention but are for explanation and understanding only.

In the Drawings.

DESCRIPTION OF THE PREFERRED EMBODIMENT

Figure 1:
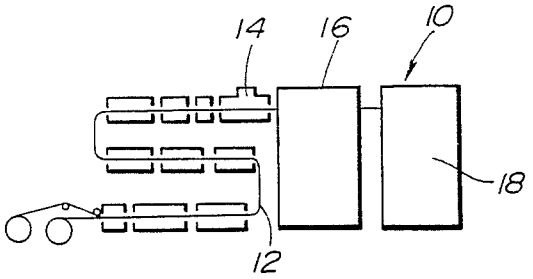
FIG. 1 is a fragmentary illustration of a general construction of an inlet portion of an annealing furnace, to which the preferred embodiment of a method for leveling a metal strip and a leveling device therefor are applicable.
Figure 2:
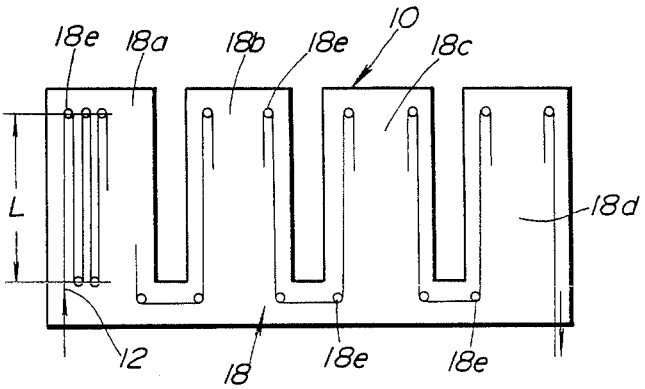
FIG. 2 is an illustration of the annealing furnace for performing continuous annealing for a series of metal strip.
Figure 3:
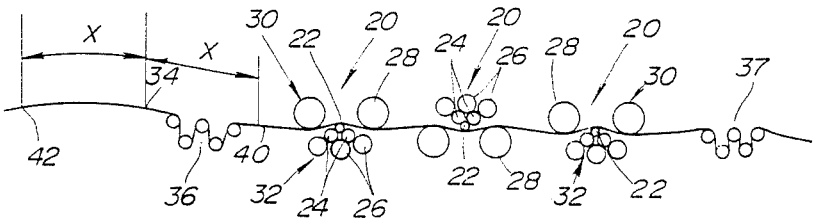
FIG. 3 is an illustration of an arrangement of leveling rollers of the preferred embodiment of the leveling device according to the invention.

Referring now to the drawings, particularly to FIGS. 1 to 3, annealing furnace 10 to which the preferred embodiment of a method for leveling a metal strip 12 and a leveling device 14 for implementing the preferred embodiment of the leveling method according to the invention, has an inlet side looper 16 at a position upstream of a furnace chamber 18. The preferred embodiment of the leveling device 14 is provided at a position upstream of the inlet side looper 16. The leveling device 14 to be employed is a tension leveling device.

The furnace chamber 18 is divided into a plurality of zones, i.e. heating zone 18*a*, a soaking zone 18*b*, a moderate cooling zone 18*c* and quick cooling zone 18*d*. A plurality of hearth rolls 18*e* are arranged in the furnace chamber 18 to define a zig-zag path for the metal strip 12. As is well known, the hearth rolls are separated into two groups, in which one group is located adjacent the ceiling of the annealing furnace and the other group of rolls are located adjacent the floor of the furnace. Therefore, the rolls in the one group are spaced from preceding and trailing rolls in other group at a predetermined span L.

As shown in FIG. 3, the preferred embodiment of the leveling device 14 comprises a plurality of leveling roll assemblies 20. Each leveling roller assembly comprises a work roll 22, intermediate rolls 24, and back-up rolls 26 and deflector rolls 28. The deflector rolls 28 forming a deflector roll assembly 30 are oriented opposite side to the work roll 22, the intermediate roll 24 and the back-up rolls 26 which form a work roll assembly 32 with respect to the metal strip path. The leveling roll assemblies 20 are arranged along the metal strip path in the leveling device 14 with a given interval. The leveling roll assemblies 20 are respectively associated with known mechanisms for shifting the work roll assembly 32 toward and away from the deflector roll assembly 30 so as to release the work rolls from the metal strip while the welding joint 34 on the metal strip 12 passes through the leveling device 14. Bridle rolls 36 and 38 are provided at the upstream end and the downstream end of the leveling device 14 for controlling the tension to be exerted on the metal strip 12 passing through the leveling device.

In the shown embodiment, the leveling roll assemblies 20 are operated to be open at a point 40 of the metal strip at a location x (m) ahead of the welded joint 34 and to return to closed position after x (m) from the welded joint at a point 42. Namely, when the point 40 of the metal strip arrives at the leveling device 14, the leveling roll assemblies 20 are operated in the open position, in which the work roll assemblies 32 are shifted away from the deflector roll assemblies 30 to free the metal strip from rolling pressure. The leveling roll assemblies 20 are operated to the closed position to contact the work roll 22 and the deflector rolls 28 onto the opposite sides of the metal strip when the point 42 passes the outlet of the leveling device.

Figure 4:
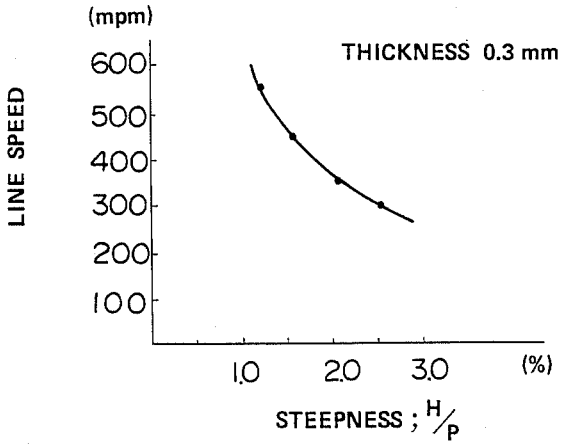
FIG. 4 is a graph showing line speed plotted against steepness of the metal strip, which steepness is defined as the ratio of the height of a peak of the uneveness (H) versus pitch between peak and adjacent bottom (P)

On the other hand, when the leveling roll assemblies 20 are in a closed position to contact the work rolls 22 and the deflector rolls 28 onto the surfaces of the metal strip 12, the depressions and so forth are set so that the steepness which is the ratio of the height of the peak H of the projecting uneveness versus the pitch P from the peak to the bottom of the depression, is suitable for satisfactorily high line speed in the annealing furnace. In order to check for optimum steepness, experimentation has been taken place with respect to tin plate. The result is shown in FIG. 4. As seen from FIG. 4, when the steepness is less than or equal to 1.0%, the line speed in the annealing furnace was higher than or equal to 550 m/min. This is satisfactory for obtaining high efficiency of the annealing furnace. In this view, the preferred steepness is 1.0% or smaller. By repeating bending in the leveling device with a preset depression and a given tension force exerted on the metal strip, the steepness can be reduced. In this leveling operation, elongation of the metal strip is also observed due to bending pressure and tension.

The bridle rolls 36 and 37 are controlled to provide a tension for the metal strip passing through the leveling device. The tension is so determined as to provide a given elongation expansion $\phi$ on the metal strip. Throughout the disclosure, the metal strip elongation $\phi$ (%) represents the magnitude of the tension force exerted on the metal strip. The tension force is determined to satisfy the following equation:

$$\phi \geqq 0.0082(x/8\ L)^{1.45}$$

Figure 5:
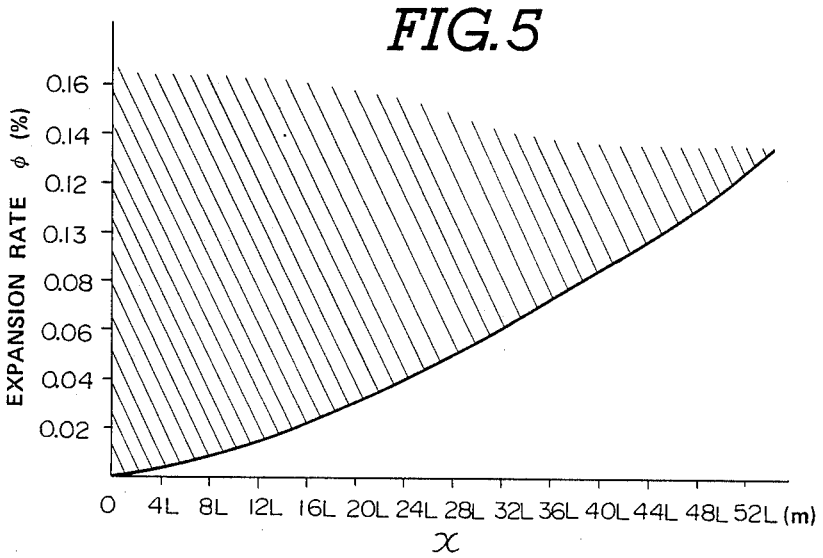
FIG. 5 is a graph showing the elongation ($\phi$%) of the metal strip relative to the distance from the leveling rollers open point and/or close point to a welded joint on the metal strip.
Figure 6:
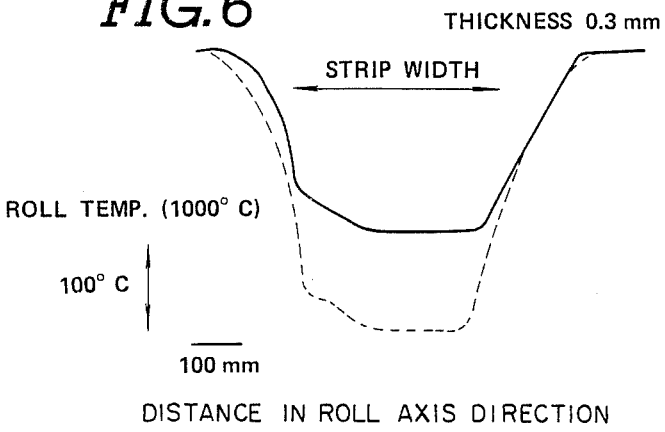
FIG. 6 is a chart showing the axial direction temperature distribution of the hearth roll at the position adjacent the inlet of the annealing furnace.

The relationship between the elongation $\phi$ (%) and the aforementioned x(m) is shown in FIG. 5. When the elongation $\phi$ (%) relative to the distance x(m) is maintained in the crosshatched range, breakage of the metal strip in the leveling device and meander of the metal strip in the annealing furnace was not present. Therefore, by setting the operating condition of the leveling device to satisfy the foregoing equation, it becomes unnecessary to slow-down the line speed at the welded joint of the metal strip but we can provide a satisfactorily stable and high efficiency annealing furnace operation.

Here, in the conventional construction, the work rolls 22 are idle rolls rotatingly driven by the metal strip fed at a given line speed. Therefore, the rotation speed of the work roll was determined corresponding to the line speed of the metal strip. In the quick open and quick close operation for avoiding breakage of the metal strip at the welded joints set forth above, substantial thrusting force may be exerted onto the bearing section of the work roll when it is released from the metal strip in the quick opening operation. On the other hand, while it is held at an open position the work roll stops. As a result, when the work roll is operated toward the metal strip in a quick closing operation, a substantial slip is created between the metal strip and the work roll to form scratches on the metal strip surface. In order to prevent this, the leveling roll assembly 20 to be employed in the preferred embodiment of the invention, has a driving mechanism 50 for driving the work roll 22 at least when the leveling roll assembly 20 is held in its open position and thus the work roll 22 is held away from the metal strip.

Figure 7:
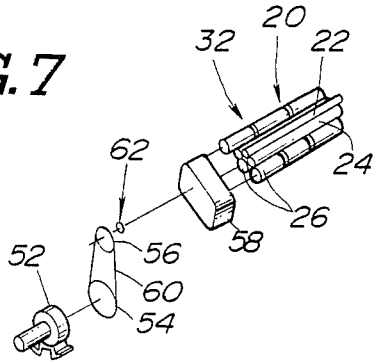
FIG. 7 is a perspective view of the preferred embodiment of a leveling roller assembly to be employed in the preferred embodiment of the leveling device according to the invention.

As shown in FIG. 7, the driving mechanism 50 comprises an electric motor 52 which drives a driving sproket 54. The driving sproket 54 is connected to a driven sproket 56 associated with a power distribution mechanism 58, via a chain 60. The power distribution mechanism 58 is associated with the back-up rolls 26 to rotatingly drive the latter. Since rotation torques thus exerted on the back-up rolls 26 are transmitted to the work roll 22 via the intermediate rolls 24.

A clutch 62 may be provided between the driven sprocket 56 and the power distribution mechanism 58 for establishing and releasing the power train in synchronism with the quick open and quick close operation of the leveling roll assembly.

Figure 8:
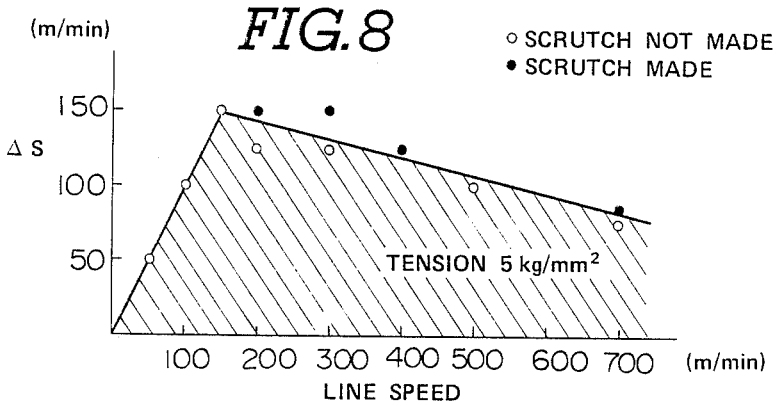
FIG. 8 is a graph showing the relationship between speed difference between the metal strip and the leveling roll and the line speed.

FIG. 8 is a graph showing the relationship between the line speed LS and the speed difference ΔS (m/min) as a result of experimentation. As will be seen from FIG. 8, when the line speed is lower than or equal to 150 m/min, scratches were not formed even when the work roll 22 was not driven to rotate. On the other hand, when the line speed was higher than 150 m/min, scratches were made when the work roll was held stopped. As further to be observed from FIG. 8, a higher speed of rotation was required to reduce the difference ΔS. Namely, when the speed difference ΔS in relation to the line speed was held in the crosshatched range, scratches will never be formed on the metal strip. Therefore, the speed of rotation of the work roll is set to satisfy the following formulae:

When LS $<150$ m/min, $\Delta S \leqq LS$; and

When $LS > 150$ (m/min)

$\Delta S \leqq -a.LS + b$ (were $a=0.124$, $b=168.6$)

Therefore, by driving the work roll while it is held released from the metal strip, formation of scratches on the metal strip can be successfully prevented during the leveling operation.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A method for leveling a metal strip fed into an annealing furnace having spaced-apart hearth rolls, which metal strip is formed into a series of strips by connecting coils at a joint, comprising the steps of:

providing offset leveling roll assemblies constituted of first and second roll components disposed between opposite sides of a path through which the metal strip is fed;

providing means for exerting a predetermined magnitude of tension force to said metal strip during the leveling operation;

depressing said first and second components of said leveling roll assembly with a predetermined pressure for leveling said metal strip;

releasing said first component of said leveling roller assembly from the mating surface of said metal strip for releasing said metal strip from depressing pressure upon encountering a joint of the series of metal strips;

rotatingly driving at least said first component while it is released from said metal strip; and adjusting said tension force exerted on the metal strip during said leveling operation to adjust the elongation of said metal strip in a predetermined relationship with said distance to satisfy the following equation:

$$\phi \geqq 0.0082(x/8\ L)^{1.45}$$

where $\phi$ is the elongation (%);

x is said distance: and

L is the span between hearth rolls in said annealing furnace.

2. A method as set froth in claim 1, wherein the rotation speed of said first component is variable depending upon the line speed of said metal strip.

3. A method as set forth in claim 2, wherein said rotation speed of said first component is so adjusted as to have a given speed difference relative to said line speed so that said speed difference is reduced as the line speed is increased.

4. A method as set forth in claim 3, wherein said rotation speed of said first component is adjusted so as to satisfy the following formula:

$$\Delta S \leqq LS$$

where

ΔS is the speed difference; and

LS is the line speed of the metal strip, when the line speed is lower than or equal to 150 m/min.

5. A method as set forth in claim 3, wherein said rotation speed of said first component is adjusted so as to satisfy the following formula:

$$\Delta S \leqq -a.LS+b$$

where
ΔS is the speed difference;
LS is the line speed of the metal strip;
a is 0.124; and
b is 168.6
when the line speed is higher than 150 m/min.

6. A method as set forth in claim 1, wherein said first component is released from said metal strip at a point a given distance ahead of the joint and contacted again to said metal strip at a point a given distance beyond said joint.

7. A method as set forth in claim 1, wherein said leveling operation is performed smoothing the surface of said metal strip to provide a steepness less than about 1%.

8. A method for leveling a metal strip fed into an annealing furnace having spaced-apart hearth rolls, which metal strip is formed into a series of strips by connecting coils at a joint, comprising the steps of:
providing an offset leveling roll assembly which is constituted of first and second roll components disposed between opposite sides of a path through which the metal strip is fed;
providing means for exerting a predetermined magnitude of tension force to said metal strip during the leveling operation;
depressing said first and second components of said leveling roll assembly with a predetermined pressure of leveling said metal strip;
releasing at least one of said first and second components of said leveling roller assembly from the mating surface of said metal strip for releasing said metal strip from depressing pressure upon encountering a joint of the series of metal strip; and
adjusting said tension force exerted on the metal strip during said leveling operation to adjust the elongation of said metal strip in a predetermined relationship with said distance to satisfy the following equation:

$$\phi \geqq 0.0082(x9\ L)^{1.45}$$

where
$\phi$ is the elongation (%);
x is said distance and
L is the span between hearth rolls in said annealing furnace.

9. A method as set forth in claim 8, wherein said leveling operation is performed for smoothing the surface of said metal strip to have steepness less than about 1%.

10. A leveling device for leveling a metal strip fed into an annealing furnace having spaced-apart hearth rolls, which metal strip is formed into a series of strips by connecting coils at a joint, comprising:
an offset leveling roll assembly which is constituted of a first and second roll components disposed between opposite sides of a path through which the metal strip is fed;
means for exerting a predetermined magnitude of tension force to said metal strip during said leveling operation;
means for depressing said first and second components of said leveling roll assembly with a predetermined pressure for leveling said metal strip;
means for releasing said first component of said leveling roller assembly from the mating surface of said metal strip for releasing said metal strip from depressing pressure upon encountering a joint of the series of metal strip;
means for rotatingly driving at least said first component while it is released from said metal strip;
wherein said driving means adjusts said rotation speed of said first component in an amount which is variable depending upon the line speed of said metal strip; and
wherein said first component is released from said metal strip at a point a given distance ahead of the joint and contacted to said metal strip at a point a given distance beyond said joint which further comprises means for adjusting said tension force to be exerted on said metal strip during said leveling operation to adjust the expansion rate of said metal strip in a predetermined relationship with said distance to satisfy the following equation;

$$\phi \geqq 0.0082(x/8\ L)^{1.45}$$

where
$\phi$ is the elongation (%);
x is said distance; and
L is the span between hearth rolls in said annealing furnace.

11. A leveling device as set forth in claim 10, wherein said driving means so adjusts the rotation speed of said first component as to provide a given speed difference relative to said line speed so that said speed difference is reduced as the line speed is increased.

12. A leveling device as set forth in claim 11, wherein said driving means is controlled to adjust the rotation speed of said first component to satisfy the following formula:

$$\Delta S \leqq LS$$

where
ΔS is the speed difference; and
LS is the line speed of the metal strip,
when the line speed is lower than or equal to 150 m/min.

13. A leveling device as set forth in claim 11, wherein said driving means is controlled to adjust said rotation speed of said said first component to satisfy the following formula:

$$\Delta S \leqq -a.\ LS+b$$

where
ΔS is the speed difference;
LS is the line speed of the metal strip;
a is 0.124; and
b is 168.6
when the line speed is higher than 150 m/min.

14. A leveling device as set forth in claim 10, wherein said first component is released from said metal strip at a point a given distance ahead of the joint and contacted to said metal strip at a point a given distance beyond said joint.

15. A leveling device as set forth in claim 10, wherein said leveling roll assembly performs a leveling operation for smoothing the surface of said metal strip to have steepness less than about 1%.

16. A leveling device for leveling a metal strip fed into an annealing furnace having spaced-apart hearth rolls, which metal strip is formed into a series of strips by connecting coils at a joint, comprising:

an offset leveling roll assembly which is constituted of first and second roll component disposed between opposite sides of a path through which the metal strip is fed;

means for exerting a predetermined magnitude of tension force to said metal strip during said leveling operation;

means for depressing said first and second components of said leveling roll assembly with a predetermined pressure for leveling said metal strip;

means for releasing said first component of said leveling roller assembly from the mating surface of said metal strip for releasing said metal strip from depressing pressure, at a joint of the series of metal strips; and means for adjusting said tension force exerted on said metal strip during said leveling operation to adjust the expansion rate of said metal strip in a predetermined relationship with said distance to satisfy the following equation:

$$\phi \geqq 0.0082\ (x/8\ L)^{1.45}$$

where $\phi$ is the elongation (%);

X is said distance; and

L is the span between hearth rolls in said annealing furnace.

17. A leveling device as set forth in claim 16, which further comprises means for adjusting said tension force to be exerted on said metal strip during said leveling operation to adjust the expansion rate of said metal strip in a predetermined relationship with said distance to satisfy the following equation:

$$\phi \geqq 0.0082(x/8\ L)^{1.45}$$

where $\phi$ is the elongation (%);

X is said distance; and

L is the span between hearth rolls in said annealing furnace.

* * * * *